US011131179B2

(12) United States Patent
Brown et al.

(10) Patent No.: US 11,131,179 B2
(45) Date of Patent: Sep. 28, 2021

(54) ELECTRIC SUBMERSIBLE PUMP GAS SEPARATOR

(71) Applicant: Halliburton Energy Services, Inc., Houston, TX (US)

(72) Inventors: Donn J. Brown, Broken Arrow, OK (US); Randy S. Roberts, Tulsa, OK (US); Thomas John Gottschalk, Houston, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 111 days.

(21) Appl. No.: 16/091,947

(22) PCT Filed: Mar. 13, 2018

(86) PCT No.: PCT/US2018/022242
§ 371 (c)(1),
(2) Date: Oct. 5, 2018

(87) PCT Pub. No.: WO2018/170002
PCT Pub. Date: Sep. 20, 2018

(65) Prior Publication Data

US 2019/0162063 A1 May 30, 2019

Related U.S. Application Data

(60) Provisional application No. 62/472,683, filed on Mar. 17, 2017.

(51) Int. Cl.
*E21B 43/38* (2006.01)
*E21B 43/12* (2006.01)
(Continued)

(52) U.S. Cl.
CPC ..... *E21B 43/38* (2013.01); *E21B 43/128* (2013.01); *F04D 7/04* (2013.01); *F04D 9/003* (2013.01); *F04D 13/08* (2013.01); *F04D 13/10* (2013.01)

(58) Field of Classification Search
CPC ..... E21B 43/38; E21B 43/128
(Continued)

(56) References Cited

U.S. PATENT DOCUMENTS 4,411,598 A 10/1983 Okada
6,113,675 A 9/2000 Branstetter
(Continued)

OTHER PUBLICATIONS

Patent Cooperation Treaty, International Search Report and Written Opinion, PCT Appln. No. PCT/US2018/022242, dated Jun. 27, 2018.

*Primary Examiner* — Taras P Bemko
(74) *Attorney, Agent, or Firm* — McGuireWoods, LLP

(57) ABSTRACT

An electric submersible pump (ESP) gas separator is described. An ESP gas separator includes a propeller upstream of a fluid entrance to a crossover, the crossover including a production pathway and a vent pathway, and the propeller including a plurality of blades comprising washout twist, wherein gas rich fluid of multi-phase fluid traveling through the gas separator flows through the propeller and into the vent pathway, and gas poor fluid of the multi-phase fluid flows around the propeller and then through the production pathway. An ESP assembly includes a gas separator between a centrifugal pump and an induction motor, the gas separator serving as an intake for fluid into the centrifugal pump and including a propeller in a separation chamber, the propeller comprising a plurality of blades, each blade having a pitch that increases in coarseness from a hub towards a shroud of the propeller.

24 Claims, 12 Drawing Sheets

(51) Int. Cl.

| | |
|---|---|
| ***F04D 13/10*** | (2006.01) |
| ***F04D 9/00*** | (2006.01) |
| ***F04D 7/04*** | (2006.01) |
| ***F04D 13/08*** | (2006.01) |

(58) Field of Classification Search
USPC ..... 166/65.1
See application file for complete search history.

(56) References Cited

U.S. PATENT DOCUMENTS

| | | | |
|---|---|---|---|
| 7,377,313 | B2 | 5/2008 | Brown et al. |
| 7,462,225 | B1 | 12/2008 | Ketter et al. |
| 2002/0178924 | A1 | 12/2002 | Brown et al. |

ELECTRIC SUBMERSIBLE PUMP GAS SEPARATOR

BACKGROUND

1. Field of the Invention

Embodiments of the invention described herein pertain to the field of electric submersible pumps. More particularly, but not by way of limitation, one or more embodiments of the invention enable an electric submersible pump gas separator.

2. Description of the Related Art

Fluid, such as gas, oil or water, is often located in underground formations. When pressure within the well is not enough to force fluid out of the well, the fluid must be pumped to the surface so that it can be collected, separated, refined, distributed and/or sold. Centrifugal pumps are typically used in electric submersible pump (ESP) applications for lifting well fluid to the surface. Centrifugal pumps impart energy to a fluid by accelerating the fluid through a rotating impeller paired with a stationary diffuser, together referred to as a "stage." In multistage centrifugal pumps, multiple stages of impeller and diffuser pairs may be used to further increase the pressure lift.

Currently available submersible pump systems are not appropriate for pumping fluids with a high gas to liquid ratio, also termed a high gas volume fraction (GVF). One problem that arises is that gas bubbles become entrained in the well fluid before entering the pump stages. If there is a sufficiently high GVF, typically around 10% to 15%, the pump may experience a decrease in efficiency and decrease in capacity or head (slipping). Additionally, gas may accumulate on the suction side of the impeller due to a pressure differential, resulting in gas bubbles blocking off the passage of fluid through the impeller. When this occurs, the pump is said to be "gas locked," which may cause delays to operation and damage to the pump components.

In gassy wells, ESPs sometimes include a gas separator interposed in the string upstream of the centrifugal pump. The gas separator attempts to remove gas from multi-phase fluid before the fluid enters the pump. Conventional vortex gas separators separate lighter components, like gas, from heavier liquids using a vortex generator that rotates with the shaft in a separation chamber. The vortex rotates the fluid, and the resulting rotational momentum encourages separation of higher density fluid and lower density fluid. Higher density fluid then continues to the pump whereas it is intended that lower density fluid vent to the casing annulus surrounding the ESP assembly.

A problem with conventional gas separators is that the conventional designs fail to remove a sufficient amount of trapped gas from the multi-phase fluid, which results in losses to efficiency and an increased likelihood of gas locking. In conventional gas separators, an auger is typically used to impart axial momentum to multi-phase fluid entering the gas separator. Augers are used because they are not as susceptible to gas locking. Unfortunately, the augers do not impart enough axial momentum to the gas particles to launch a sufficient percentage of the gas into the casing annulus. As a result, the gas does not vent, and instead becomes undesirably trapped in the fluid traveling into the pump. This causes gas locking, slipping and a decrease in pump capacity.

As is apparent from the above, currently available gas separators employed in ESPs do not remove enough gas from multi-phase fluid in high GVF applications. Therefore, there is a need for an improved electric submersible pump gas separator.

SUMMARY

One or more embodiments of the invention enable an electric submersible pump gas separator.

An electric submersible pump gas separator is described. An illustrative embodiment of an electric submersible pump (ESP) gas separator includes a propeller upstream of a fluid entrance to a crossover, the propeller including a plurality of blades, each blade of the plurality of blades including washout twist, the crossover including a production pathway and a vent pathway, and wherein gas rich fluid of multi-phase fluid travelling through the gas separator flows through the propeller and into the vent pathway, and gas poor fluid of the multi-phase fluid flows around the propeller and through the production pathway. In some embodiments, the propeller imparts axial momentum to the gas rich fluid exiting one of a vortex generator or rotary. In certain embodiments, the ESP gas separator is secured between a centrifugal pump and an induction motor, the production pathway extends to the centrifugal pump, and the vent pathway is configured to extend to a casing annulus. In some embodiments, the propeller further including a hub and a shroud, wherein the hub is keyed to a shaft of the ESP gas separator, and wherein each blade of the plurality of blades spans between the hub and the shroud. In certain embodiments, the shroud is axially aligned with a skirt of the crossover, and the gas rich fluid flows between the hub and the shroud. In some embodiments, the washout twist includes pitch that increases in coarseness from the hub to the shroud of the propeller. In certain embodiments, each blade includes an inner edge that curves concavely along an outer diameter of the hub and an outer edge that curves convexly along an inner diameter of the shroud.

An illustrative embodiment of an electrical submersible pump (ESP) gas separator includes an intake section serving as an intake for fluid from a casing annulus into an ESP assembly, a separation chamber enclosed by a supportive housing and fluidly coupled to the intake section, the separation chamber including a rotatable shaft extending centrally and longitudinally through the separation chamber, a vortex generator rotatably coupled to the rotatable shaft, a propeller within the separation chamber that receives fluid from the vortex generator, the propeller rotatably coupled to the rotatable shaft downstream of the vortex generator, the propeller including at least one blade extending between a hub and a shroud of the propeller, wherein a pitch of each of the at least one blade increases in coarseness from the hub towards the shroud, and a fluid channel extending outward of the shroud inside the housing, and a crossover downstream of the propeller, the crossover including a vent passage fluidly coupled to an inside of the shroud and the casing annulus, and a production passage fluidly coupled to the fluid channel and a production pump of the ESP assembly. In some embodiments, each of the at least one blades includes an inner edge that curves concavely along an outer diameter of the hub, and an outer edge that curves convexly along an inner diameter of the shroud. In certain embodiments, each of the at least one blade twists such that at a leading edge of the at least one blade, the inner edge is in front of the outer edge, and at a trailing edge of the at least one blade the outer edge is in front of the inner edge. In some embodiments, each of the at least one blade includes washout twist. In certain embodiments, an angle of incidence of each of the at least one blade, measured from a longitudinal axis, about doubles from the hub to the shroud. In some embodiments, a leading edge of each of the at least one blade is below a trailing edge of the at least one blade. In certain embodiments, an upper face of each of the at least one blade includes a convex portion and a concave portion. In some embodiments, the propeller includes four blades circumferentially spaced around the hub and the four blades curve helically around the hub. In certain embodiments, the propeller imparts axial momentum to fluid flowing through an inside of the propeller between the shroud and the hub.

An illustrative embodiment of an electric submersible pump (ESP) assembly includes a gas separator between a centrifugal pump and an induction motor, the gas separator serving as an intake for fluid into the centrifugal pump and including a propeller in a separation chamber, the propeller including a plurality of blades, each blade having a pitch that increases in coarseness from a hub towards a shroud of the propeller. In some embodiments, the ESP assembly further includes a channel surrounding the shroud, the channel fluidly coupled to a centrifugal pump. In certain embodiments, a portion of the fluid that flows between the hub and the shroud of the propeller is coupled to a vent port of a crossover and the channel surrounding the shroud is fluidly coupled to the centrifugal pump. In some embodiments, the fluid includes gas and liquid, and wherein the portion of the fluid that flows between the hub and the shroud includes gas rich fluid and the channel includes gas poor fluid. In certain embodiments, the gas separator includes a vortex generator upstream of the propeller. In some embodiments, the gas separator includes a rotor upstream of the propeller. In certain embodiments, the ESP assembly is configured for placement in a downhole well and the fluid includes oil and gas. In some embodiments, each blade of the plurality of blades includes washout twist. In certain embodiments, each blade of the plurality of blades is concave at the hub and convex at the shroud.

In further embodiments, features from specific embodiments may be combined with features from other embodiments. For example, features from one embodiment may be combined with features from any of the other embodiments. In further embodiments, additional features may be added to the specific embodiments described herein.

BRIEF DESCRIPTION OF THE DRAWINGS

Advantages of the present invention may become apparent to those skilled in the art with the benefit of the following detailed description and upon reference to the accompanying drawings in which.

Figure 1:
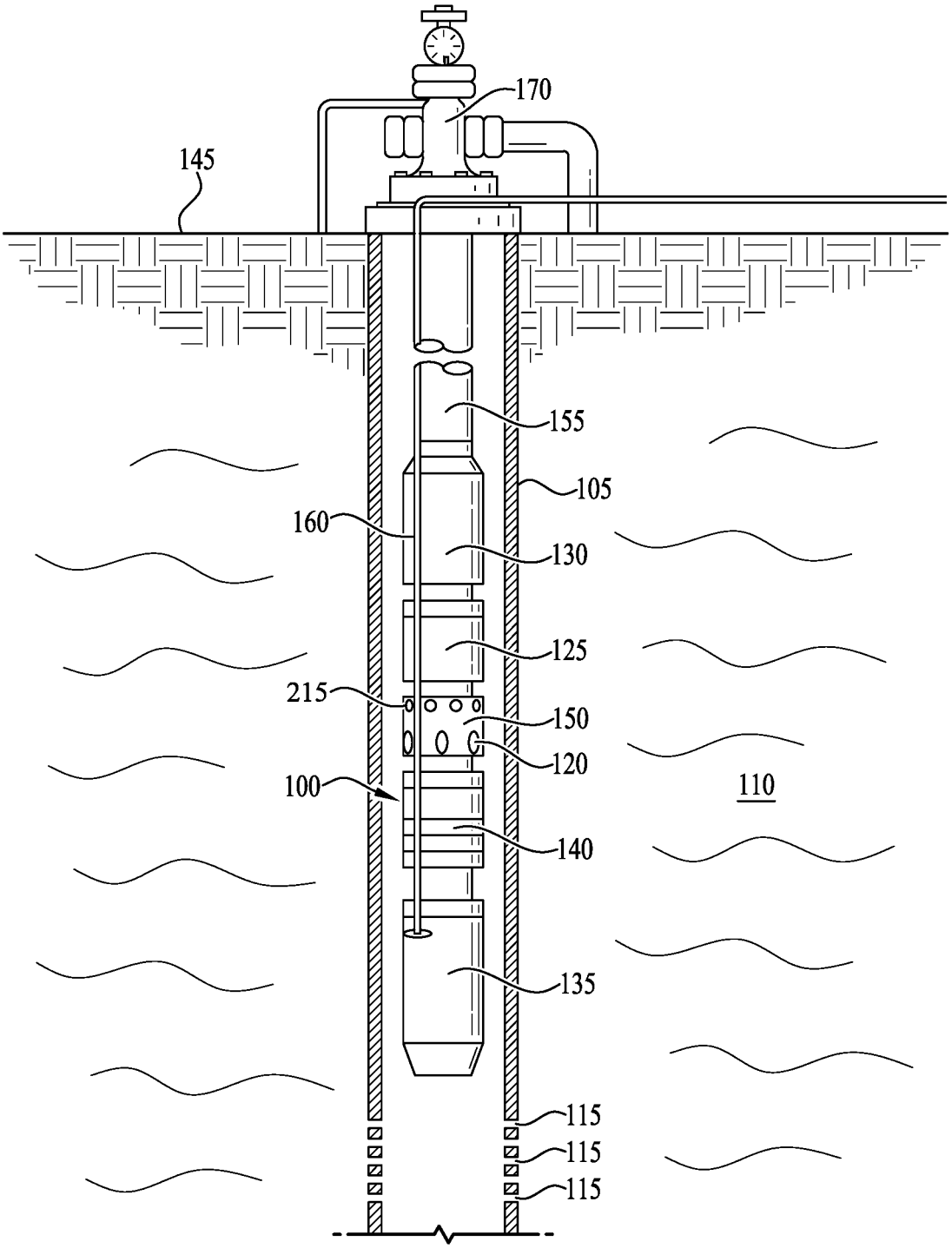
FIG. 1 is an elevation view of an electric submersible pump (ESP) assembly of an illustrative embodiment.

While the invention is susceptible to various modifications and alternative forms, specific embodiments thereof are shown by way of example in the drawings and may herein be described in detail. The drawings may not be to scale. It should be understood, however, that the embodiments described herein and shown in the drawings are not intended to limit the invention to the particular form disclosed, but on the contrary, the intention is to cover all modifications, equivalents and alternatives falling within the scope of the present invention as defined by the appended claims.

DETAILED DESCRIPTION

An electric submersible pump (ESP) gas separator is described. In the following exemplary description, numerous specific details are set forth in order to provide a more thorough understanding of embodiments of the invention. It will be apparent, however, to an artisan of ordinary skill that the present invention may be practiced without incorporating all aspects of the specific details described herein. In other instances, specific features, quantities, or measurements well known to those of ordinary skill in the art have not been described in detail so as not to obscure the invention. Readers should note that although examples of the invention are set forth herein, the claims, and the full scope of any equivalents, are what define the metes and bounds of the invention.

As used in this specification and the appended claims, the singular forms "a", "an" and "the" include plural referents unless the context clearly dictates otherwise. Thus, for example, reference to a "blade" includes one or more blades.

"Coupled" refers to either a direct connection or an indirect connection (e.g., at least one intervening connection) between one or more objects or components. The phrase "directly attached" means a direct connection between objects or components.

As used herein the terms "axial", "axially", "longitudinal" and "longitudinally" refer interchangeably to the direction extending along the length of the shaft of an ESP assembly component such as an ESP intake, multi-stage centrifugal pump, seal section, gas separator or charge pump.

"Downstream" refers to the longitudinal direction substantially with the principal flow of lifted fluid when the pump assembly is in operation. By way of example but not limitation, in a vertical downhole ESP assembly, the downstream direction may be through the well in a direction towards the wellhead. The "top" of an element refers to the downstream-most side of the element, without regard to whether the ESP assembly is horizontal, vertical, angled or extends through a bend.

"Upstream" refers to the longitudinal direction substantially opposite the principal flow of lifted fluid when the pump assembly is in operation. By way of example but not limitation, in a vertical downhole ESP assembly, the upstream direction may be through the well in a direction opposite the wellhead. The "bottom" of an element refers to the upstream-most side of the element, without regard to whether the ESP assembly is horizontal, vertical, angled or extends through a bend.

As used herein, with respect to a blade angle, "course" means angled towards horizontal, where horizontal is 90° from longitudinal. "Fine" means angled towards a longitudinal direction.

As used herein, "washout" refers to the twist of a propeller blade such that thrust remains constant across the span of the blade.

With respect to multi-phase fluid flowing through a gas separator, the gas separator of illustrative embodiments may divide the multi-phase fluid into two portions, a first portion having higher density, gas poor fluid and a second portion having lower density, gas rich fluid. As used in this specification and the appended claims, "gas poor fluid" means fluid that has a lower gas volume fraction (GVF) than the "gas rich fluid," where both the gas poor fluid and the gas rich fluid are produced from the multi-phase fluid entering the gas separator of illustrative embodiments.

For ease of description, illustrative embodiments described herein are primarily in terms of a downhole ESP assembly employing a vortex type gas separator. However, illustrative embodiments may equally be applied to rotary type gas separators and/or any pump lifting multi-phase fluid using rotational momentum where it is desirable to separate gas from liquid.

Illustrative embodiments may reduce GVF in a multi-phase fluid before the fluid enters an ESP centrifugal pump. Illustrative embodiments may increase axial momentum of gas rich fluid in a separation chamber, provide improved ventilation of gas rich fluid into the casing annulus and may reduce the volume of gas entering the production pump. Illustrative embodiments may increase axial momentum of lighter density, gas rich fluid using a propeller that imparts constant thrust across the span of the propeller blades. They propeller of illustrative embodiments may minimize radial momentum of gas rich fluid after the gas rich fluid has been separated from gas poor fluid, thereby decreasing the likelihood of re-entrapment of gas. During operation, the propeller of illustrative embodiments may be aligned to increase axial momentum of the gas rich fluid while having little or no effect on the momentum of the gas poor fluid. The propeller of illustrative embodiments may improve fluid dynamics within the separation chamber by placing the propeller inside the separation chamber rather than inside the crossover.

An illustrative embodiment of a gas separator includes a propeller inside a separation chamber of a gas separator, downstream of a vortex generator or a rotor. The propeller may be smaller diametrically than the inner diameter of the separation chamber housing, and arranged centrally around the shaft of the separation chamber. The propeller of illustrative embodiments may be axially aligned with slower, gas rich fluid, which tends to concentrate inward near the shaft, and may impart axial momentum to such gas rich fluid traveling through the separation chamber towards the crossover vents. On the other hand, higher density, gas poor fluid, which tends to concentrate outward near the housing of the separation chamber, may flow through a production channel passing around the outer diameter of the propeller before continuing towards a centrifugal pump. Separation of gas and liquid in multi-phase production fluids may thus be improved.

Illustrative embodiments may include an artificial lift assembly, such as an ESP assembly, which may be located downhole below the surface of the ground. FIG. 1 shows an exemplary ESP assembly. ESP assembly 100 may be positioned within well casing 105, which may separate ESP assembly 100 from underground formation 110. Well fluid may enter casing 105 through perforations 115 and travel downstream to intake ports 120. Intake ports 120 may serve as the fluid intake for ESP assembly 100 and may be located on an ESP intake section and/or may be integral to gas separator 150. Gas separator 150 may be a vortex or rotary type separator and may separate gas from the well fluid after intake of the fluid into ESP assembly 100, but prior to the fluid entering pump 130. Motor 135 may be an electric submersible motor that operates to turn ESP pump 130 and may, for example, be a two-pole, three-phase squirrel cage induction motor. Power cable 160 may provide power to motor 135 and connect to a power source on surface 145. Seal section 140 may be a motor protector, serving to equalize pressure and keep motor oil separate from well fluid. ESP Pump 130 may be a multi-stage centrifugal pump having stacked impeller and diffuser stages, and may lift fluid to surface 145. Production tubing 155 may carry pumped fluid to wellhead 170 and/or surface 145, and then into a pipeline, storage tank, transportation vehicle and/or other storage, distribution or transportation means. In gassy wells, charge pump 125 may be employed as a lower tandem pump to boost fluid before it enters production pump 130. Charge pump 125 may reduce the net positive suction head required, allowing ESP production pump 130 to operate in low inflow pressure conditions that may be caused by gas ingress.

Figure 2:
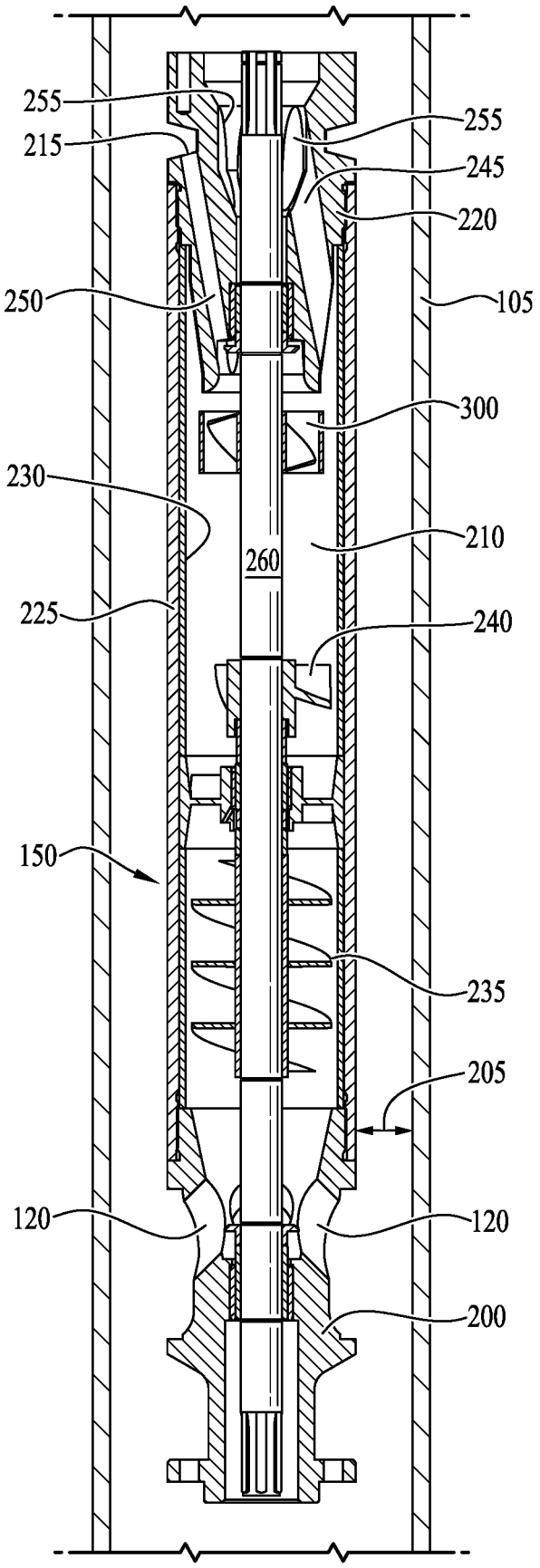
FIG. 2 is a cross sectional view of a gas separator of an illustrative embodiment.

FIG. 2 illustrates a gas separator of an illustrative embodiment. Gas separator 150 may include intake section 200 where multi-phase fluid enters gas separator 150 from casing annulus 205, separation chamber 210 where higher-density, gas poor fluid may be separated from lower-density, gas rich fluid, and crossover 220 where higher-density fluid may be sent to centrifugal pump 130 and lower-density fluid may be vented back to casing annulus 205. Intake ports 120 may be spaced circumferentially around intake section 200 and serve as the intake for fluid into ESP assembly 100 and/or gas separator 150. Vent ports 215 may be spaced around crossover 220 and may allow lower density, gas rich fluid to exit gas separator 150 and vent into casing annulus 205. Shaft 260 may be rotated by ESP motor 135 (either directly or via the intervening splined shaft of seal section 140) and extend longitudinally and centrally through gas separator 150. Housing 225 may separate separation chamber 210 and/or crossover 220 from casing annulus 205. Housing 225 may be a supportive structure that transmits axial loads across gas separator 150. Liner 230 may provide a corrosion resistant lining to housing 225 and/or serve as the outer containment for higher-density, gas poor fluid entering production passage 245.

Multi-phase well fluid may enter intake ports 120 and travel downstream through separation chamber 210. Auger 235 may be keyed to gas separator shaft 260 to rotate with shaft 260, and may impart axial momentum to multi-phase well fluid travelling through separation chamber 210. Auger 235 may be a conveyer auger (screw auger) that includes a rotating helical flighting. In some embodiments, auger 235 may be replaced with an impeller as a fluid moving element in separation chamber 210. In separation chamber 210, gas and liquid of the multi-phase fluid may be separated or at least partially separated. In vortex type gas separators 150 as shown in FIG. 2, vortex generator 240 may be rotatably keyed to shaft 260 and may whirl and/or swirl fluid moving through separation chamber 210. One or more vortex generators 240 may be included downstream of auger 235. Using rotational momentum, vortex generator 240 may induce lighter-density, gas rich fluid to move inwards towards shaft 260 and higher-density, gas poor fluid to move outward towards liner 230 and/or housing 225. In some embodiments, gas separator 150 may be a rotary type separator and, rather than vortex generator 240, include a rotor within separation chamber 210 to encourage centrifugal separation of gas poor fluid and gas rich fluid.

From separation chamber 210, the multi-phase fluid may proceed to passages of crossover 220 where lower-density, gas rich fluid may be vented into casing annulus 205 through vent passage 250 and vent ports 215, whereas higher-density, gas poor fluid may continue through production passage 245 and production passage openings 255 to pump 130. Fluid continuing through production passage openings 255 to pump 130 may have a lower GVF than fluid entering intake ports 120.

Figure 4:
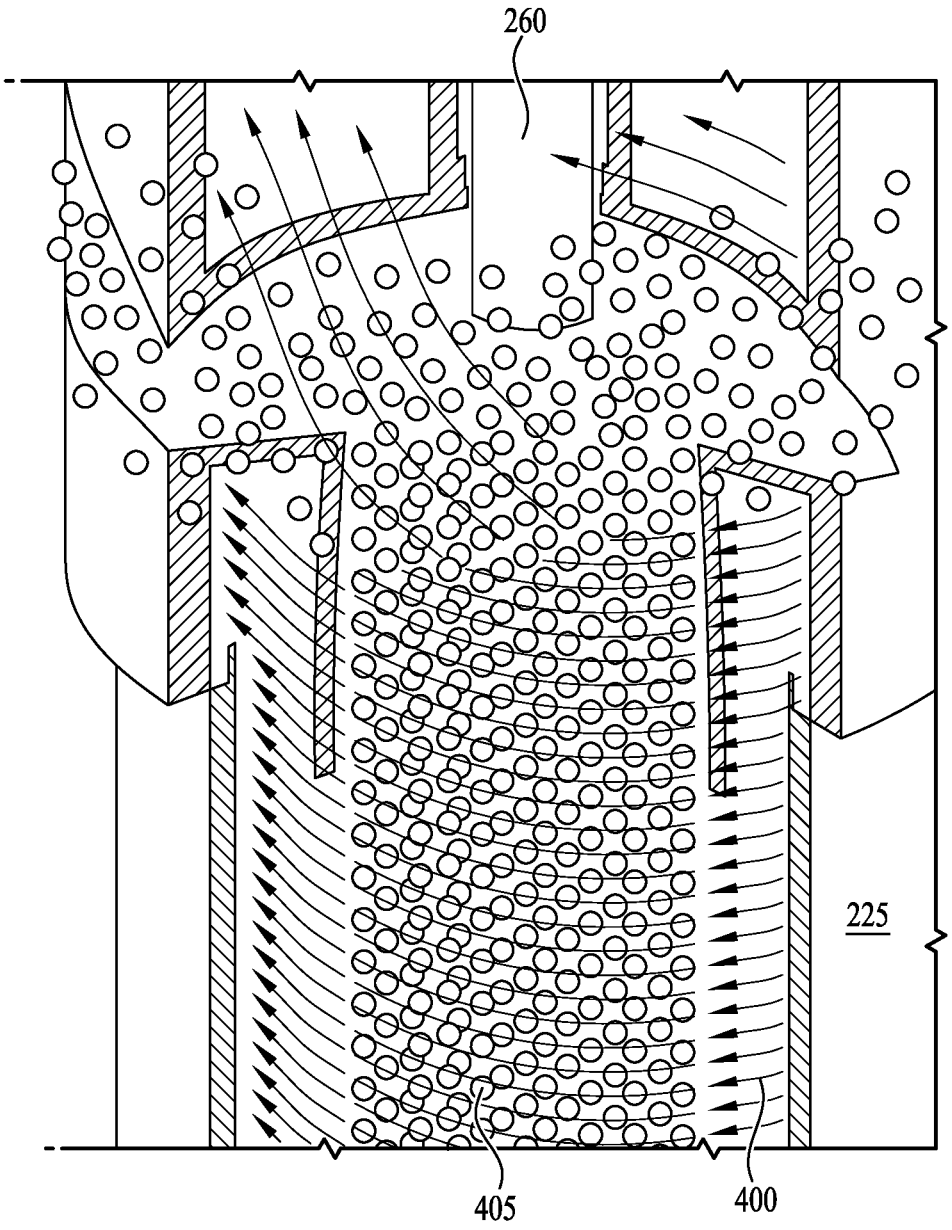
FIG. 4 is a schematic diagram of multi-phase fluid flow of an illustrative embodiment.

The inventors have observed that when multiphase fluid exits a rotary or vortex generator 240, faster moving fluid is propelled outwards towards housing 225, whereas slower moving fluid remains closer to shaft 260. The inventors have also observed that the slower moving fluid, concentrated around shaft 260, contains a higher percentage of gas than liquid. Gas, such as natural gas, may have a lower density than liquid, such as oil, in a multi-phase fluid. Vortex generator 240 therefore may impart less momentum to the lower-density gas than to the heavier liquid. Additionally, axial momentum imparted on the well fluid by auger 235 may be more readily lost by the gas than the liquid, which may further decrease the likelihood of efficient gas ventilation. FIG. 4 illustrates a simulation of fluid entering crossover 220. Gas poor fluid 400 may be pushed radially outward toward housing 225 inner diameter as the multi-phase fluid travels downstream towards crossover 220, while gas rich fluid 405 may be concentrated radially inwards around shaft 260.

A gas separator of illustrative embodiments may include an enclosed aircraft-style propeller within separation chamber 210, which propeller may receive lighter, gas rich fluid 405 from vortex generator 240 and/or a rotor and beneficially propel the gas rich fluid towards crossover 220. FIG. 2 illustrates propeller 300 of an illustrative embodiment employed within gas separator 150. Propeller 300 may axially accelerate the lighter, gas rich fluid 405 through separation chamber 210 without causing gas rich fluid 405 to move radially outward. Propeller 300 may therefore advantageously add axial momentum to the lighter, gas rich fluid 405 so that it may vent to casing annulus 205 without becoming entrained with the heavier gas poor fluid 400 and/or losing momentum. Increased axial momentum of gas rich fluid 405 applied by propeller 300 may provide increased ventilation and greater efficiency of fluid movement in separation chamber 210, which may allow improved separation of gas rich fluid 405 from multi-phase fluid, and decrease the GVF of fluid lifted by ESP centrifugal pump 130. Propeller 300 may be placed in the fluid stream within separation chamber 210, rather than inside crossover 220, thereby improving the efficiency of fluid movement within separation chamber 210.

Figure 3A:
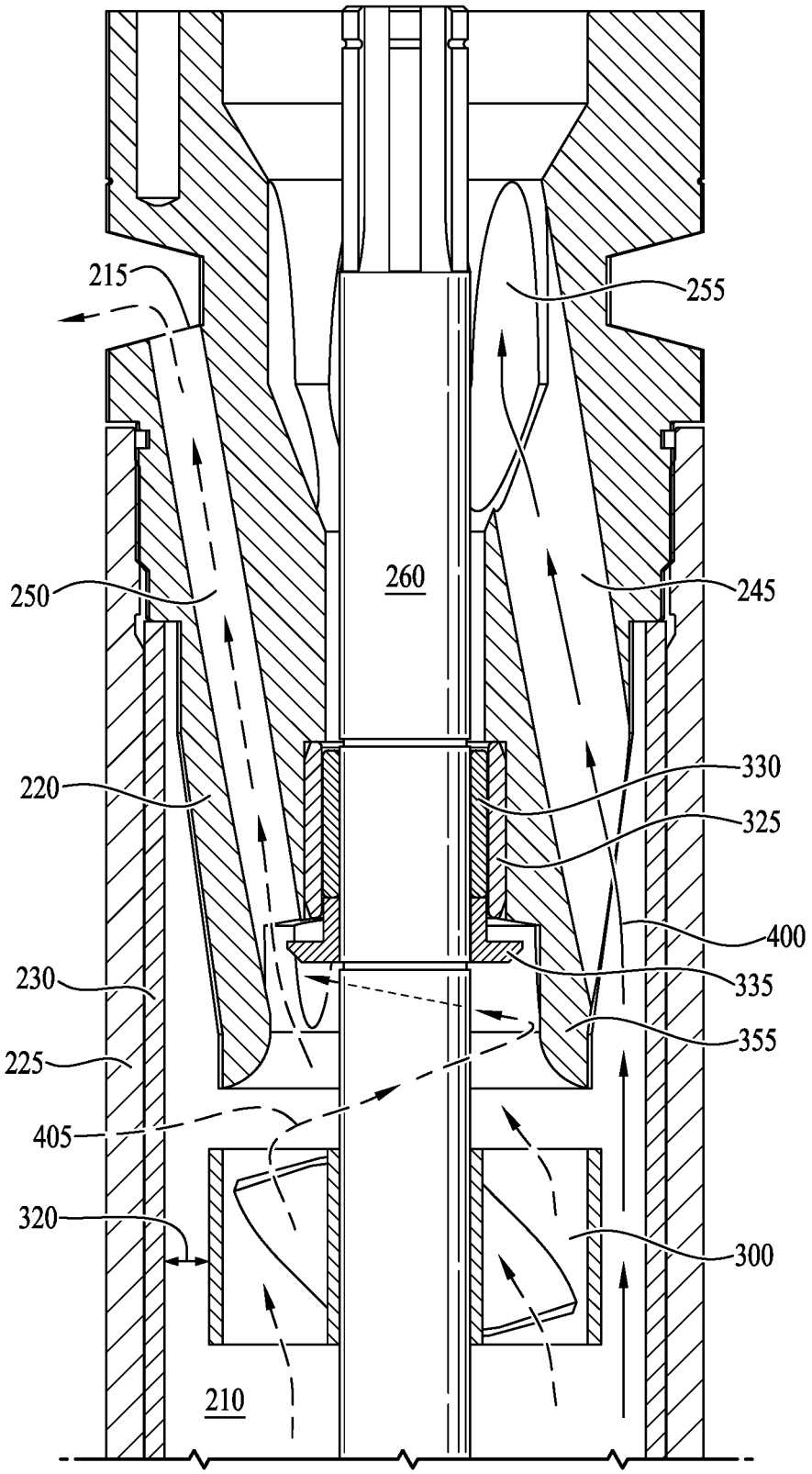
FIGS. 3A-3B are cross sectional views of a separation chamber and crossover of an illustrative embodiment.
Figure 3B:
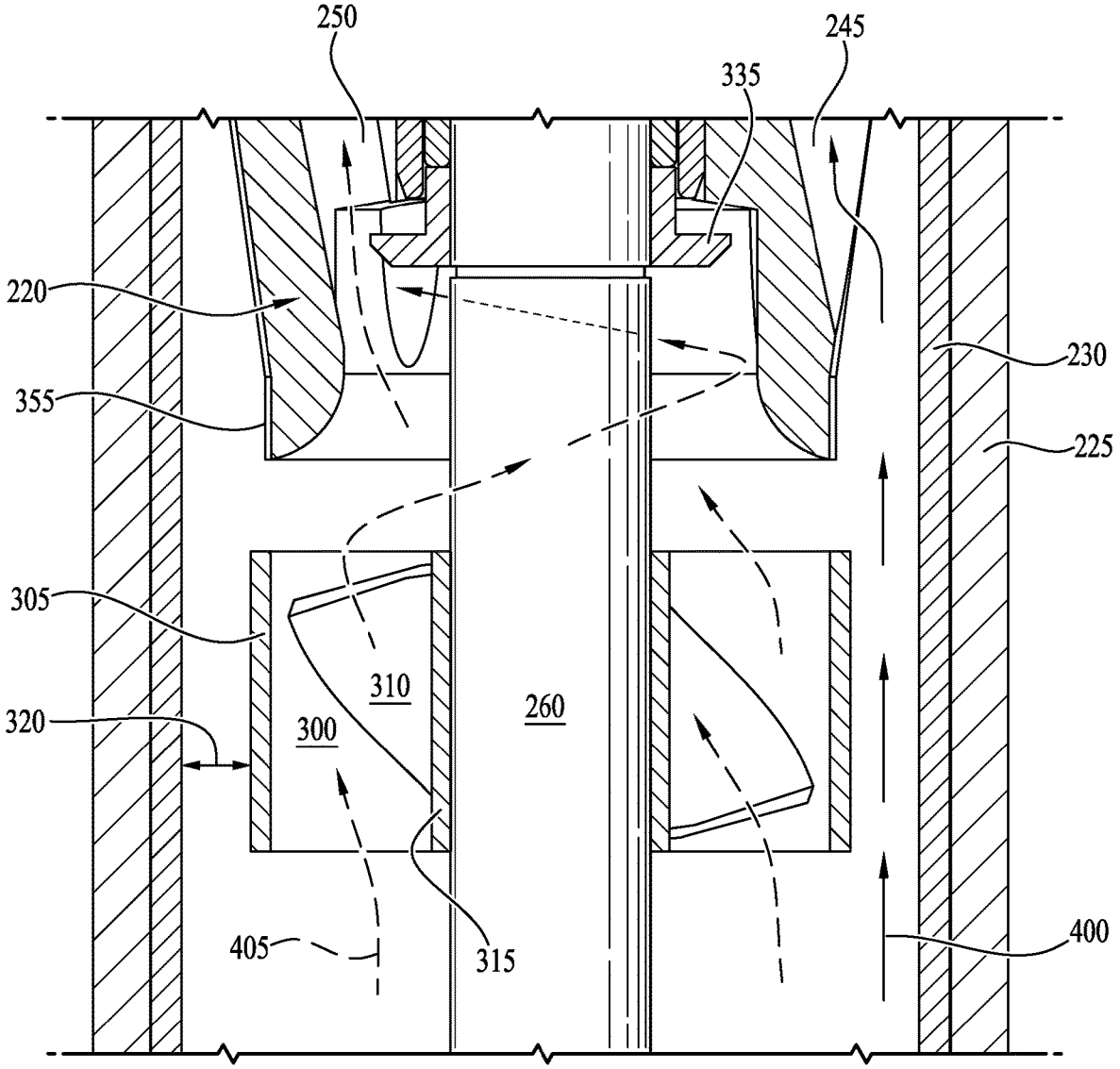

Turning to FIGS. 3A-3B, propeller 300 may be included in separation chamber 210 downstream of vortex generator 240, a rotor and/or below the fluid entrance to crossover 220. As opposed to an impeller, propeller 300 may predominantly impart axial momentum to fluid passing through propeller 300, rather than radial momentum. In the example shown in FIGS. 3A and 3B, propeller 300 may be adjacent to and/or just upstream of entrance to crossover 220, inside separation chamber 210. In some illustrative embodiments, propeller 300 may be secured at any location along shaft 260 between crossover 220 inlet and vortex generator 240 and/or rotor outlet. Where gas separator 150 is a rotary-type separator, propeller 300 may be placed above the rotor and/or at the rotor fluid exit. In such rotary embodiments, propeller 300 may direct gas rich fluid out of the straight vanes of the rotor and into vent passage 250 of crossover 220, creating a flow path within the rotor to help remove lower density, gas rich fluid.

Propeller 300 may be aligned with crossover skirt 355 and/or may be commensurate or about commensurate in diameter with crossover skirt 355. As shown in FIG. 3A and FIG. 3B, propeller 300 may boost the momentum of lower density, gas rich fluid 405 entering crossover 220. Propeller 300 may be arranged circumferentially around shaft 260 and have a diameter smaller than the inner diameter of liner 230 and/or housing 225, to form channel 320 between the outer diameter of propeller 300 and the inner diameter of liner 230 and/or housing 225. Gas poor fluid 400 may flow through channel 320 on its way to production passage 245. Bearings may provide thrust and/or radial support to shaft 260. Bushing 325 may be pressed into crossover 220 and remain stationary as sleeve 330 rotates with shaft 260 within bushing 325. Flange 335 may provide thrust support.

Figure 5A:
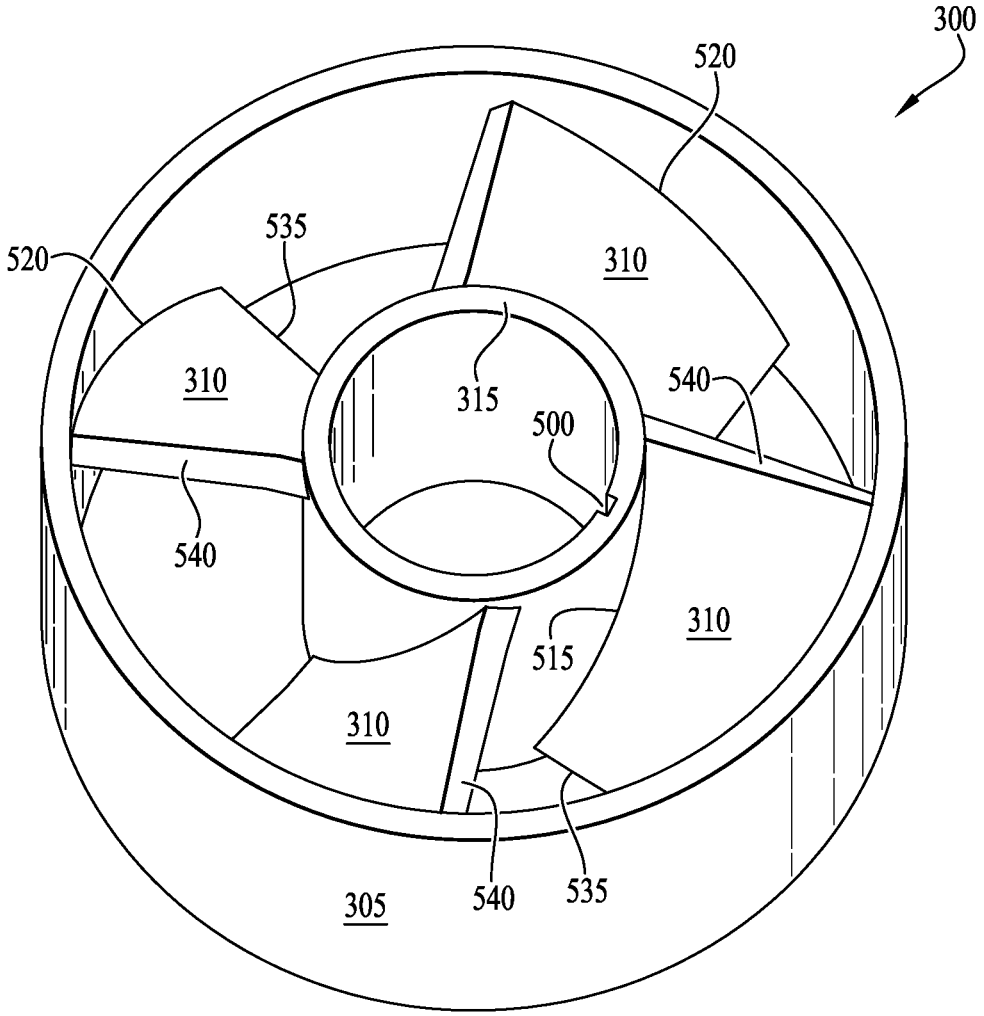
FIG. 5A is a perspective view of a propeller of an illustrative embodiment.
Figure 5B:
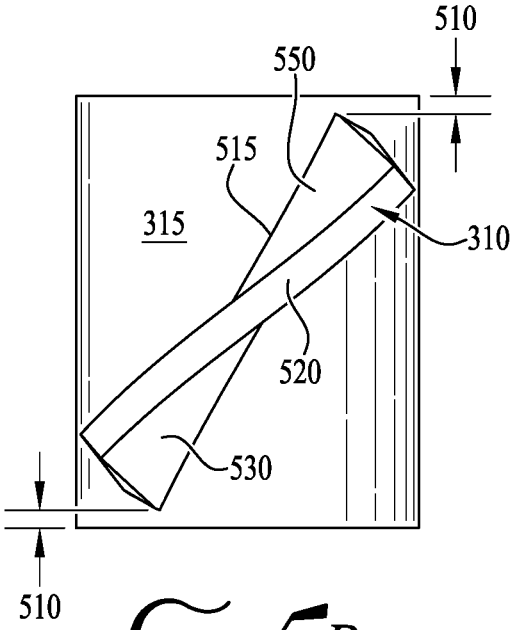
FIG. 5B is a side elevation view of a blade and hub of a propeller of an illustrative embodiment.
Figure 5C:
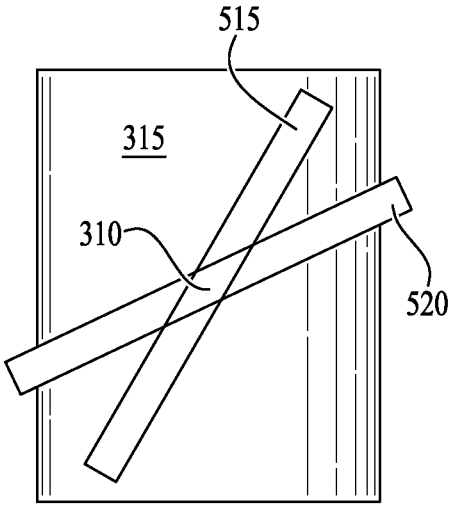
FIG. 5C is a side elevation view of blade loft surfaces and a hub of a propeller of an illustrative embodiment.
Figure 5D:
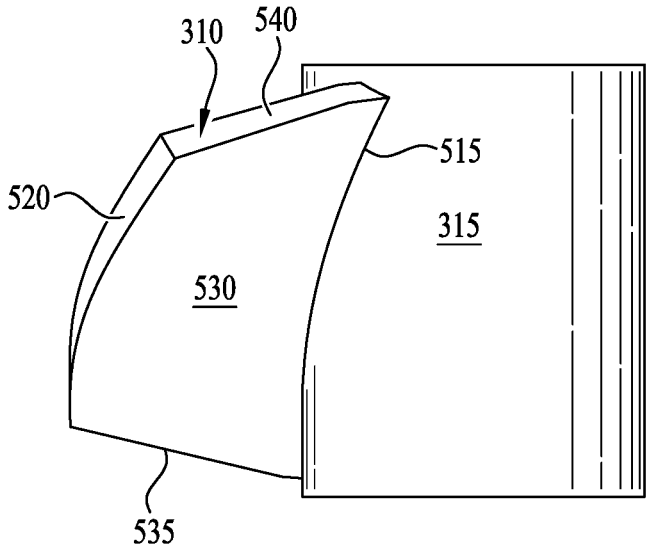
FIG. 5D is a rotated side elevation view of the blade and hub of the propeller of FIG. 5B of an illustrative embodiment.
Figure 5E:
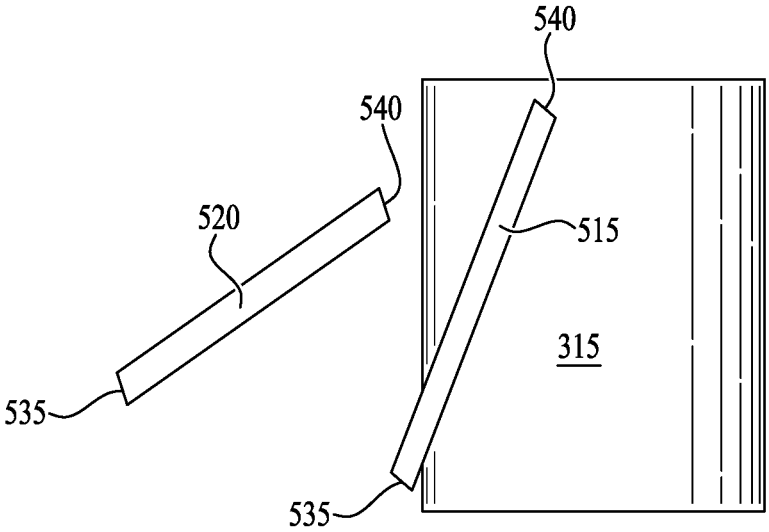
FIG. 5E is a side view of loft surfaces and a hub of a propeller of illustrative embodiments.
Figure 5F:
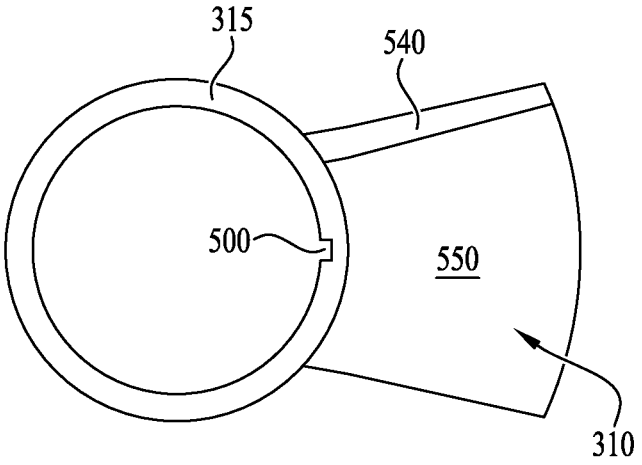
FIG. 5F is a top plan view of a blade and hub of a propeller of an illustrative embodiment.
Figure 5G:
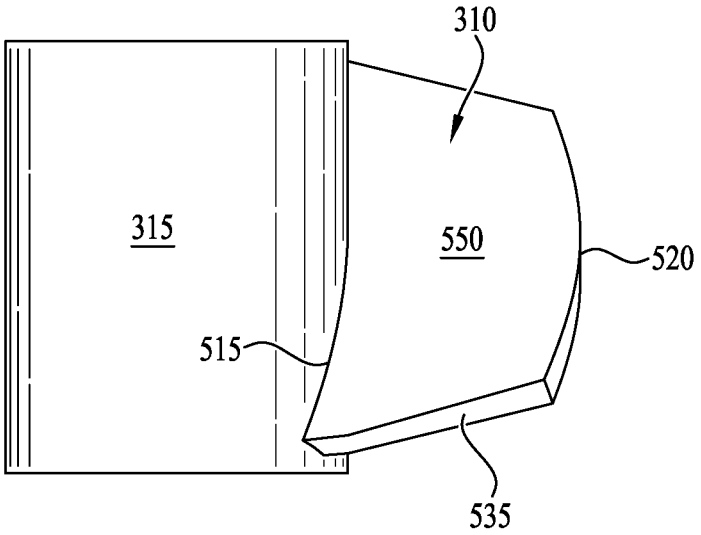
FIG. 5G is a side elevation view of a blade and hub of a propeller of an illustrative embodiment.
Figure 5H:
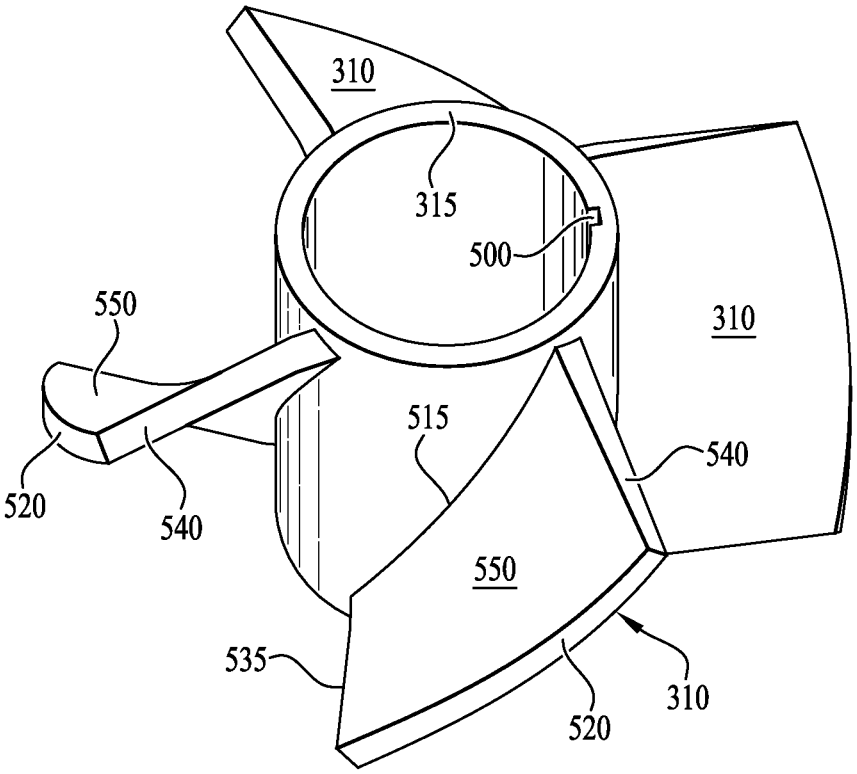
FIG. 5H is an isometric view of a hub and four blades of a propeller of an illustrative embodiment.

FIGS. 5A-5J illustrate an exemplary propeller 300 of illustrative embodiments. As shown in FIG. 5A, propeller 300 may include shroud 305 that circumferentially encloses propeller 300 and assists in directing fluid flow through and/or around propeller 300. Hub 315 may include keyway 500 that may couple shaft 260 to hub 315 with a corresponding key inserted into keyway 500 as well as a keyway along shaft 260, such that propeller 300 rotates with shaft 260. In some embodiments, a bolted, threaded, friction-fit, or other similar connection may couple hub 315 to shaft 260 such that propeller 300 rotates with shaft 260. Propeller 300 may include one or more blades 310 arranged around hub 315 and spanning between hub 315 and shroud 305. As perhaps best illustrated in FIG. 5J, propeller blades 310 may extend between inner diameter 340 of shroud 305 and outer diameter 350 of hub 315. The exemplary propeller 300 illustrated in FIG. 5J rotates clockwise as viewed from above, as illustrated by rotation arrow 505. Turning to FIG. 5B, blades 310 may angle along the height of hub 315, with a small clearance 510 at the top and bottom of hub 315, for example clearance 510 may be about 0.1-0.2 inches (0.25-0.5 cm) axially. Propeller 300 may include one or more blades 310, for example one, three, four or six blades 310. In the example of FIG. 5A and FIG. 5H, four blades 310 are shown. During operation, lower density, gas rich fluid 405 may travel through propeller 300 between shroud inner diameter 340 and hub outer diameter 350 and, in doing so, may gain axial momentum from rotation of propeller 300, the axial momentum imparted to gas rich fluid with constant thrust across the span of blades 310.

Referring to FIGS. 5B-5C, propeller blades 310 may each be sloped at an angle between horizontal and longitudinal, as blade 310 curves along hub 315 and/or shroud 305. The pitch and/or steepness of each blade 310 may be inconstant in a radial direction along blade 310, specifically such that the pitch of each blade 310 increases in coarseness and/or decreases in steepness from hub 315 towards shroud 305. Thus, inner edge 515 of blade 310 may curve along hub 315 more finely than outer edge 520 of same blade 310 curves along shroud 305, creating a "twisted" shape to each blade 310 as illustrated in FIG. 5B. The twisted shape of blades 310 may have a steeper (finer) pitch near hub 315, where the blade is rotating slowest, and a shallower (coarser) pitch near shroud 305, where blade 310 is rotating fastest. The angle of incidence of each blade 310 may be greater at inner edge 515 than at outer edge 520. Referring to FIG. 5D, blades 310 may curve and/or wrap helically around hub 315, curving upward from leading edge 535 to trailing edge 540 of blade 310. Inner edge 515 of blade 310 may form a concave curve along hub 315, whereas outer edge (tip) 520 of blade 310 may form a convex curve along shroud 305. In the example shown in FIGS. 5C and 5E, the outer edge 520 of blade 310 proximate shroud 305 may be angled 60° from longitudinal, whereas, inner edge 515 of blade 310 proximate hub 315 may be angled about 30° from longitudinal. Other similar angles and/or angle differentials may be employed, but the pitch (steepness) of blade 310 from leading edge 535 to trailing edge 540 should become coarser from hub 315 to shroud 305 to maintain constant axial thrust radially across the span of blade 310 and/or washout. Blade 310 may twist such that at leading edge 535 of blade 310, inner edge 515 is in front of the outer edge 520, and at trailing edge 540 of same blade 310, outer edge 520 is in front of inner edge 515.

Figure 5I:
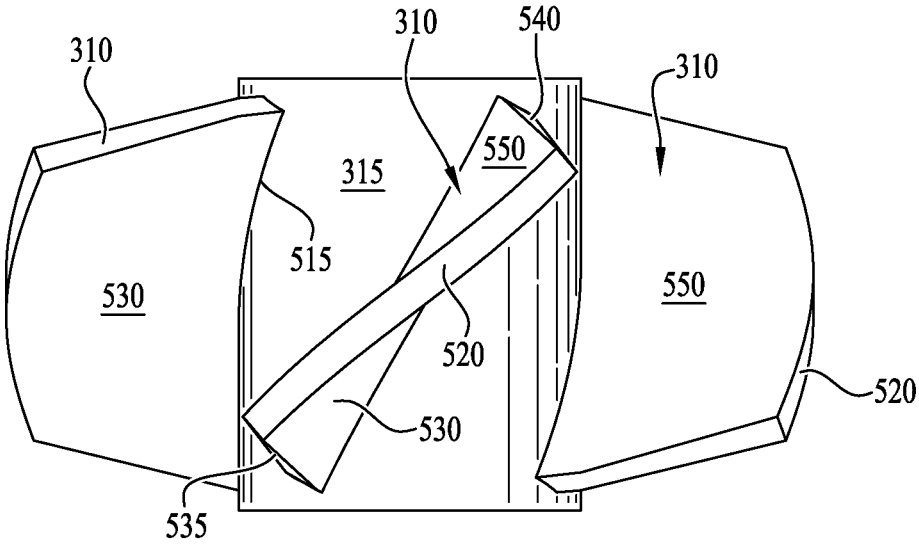
FIG. 5I is a side elevation view of hub and blades of a propeller of an illustrative embodiment.
Figure 5J:
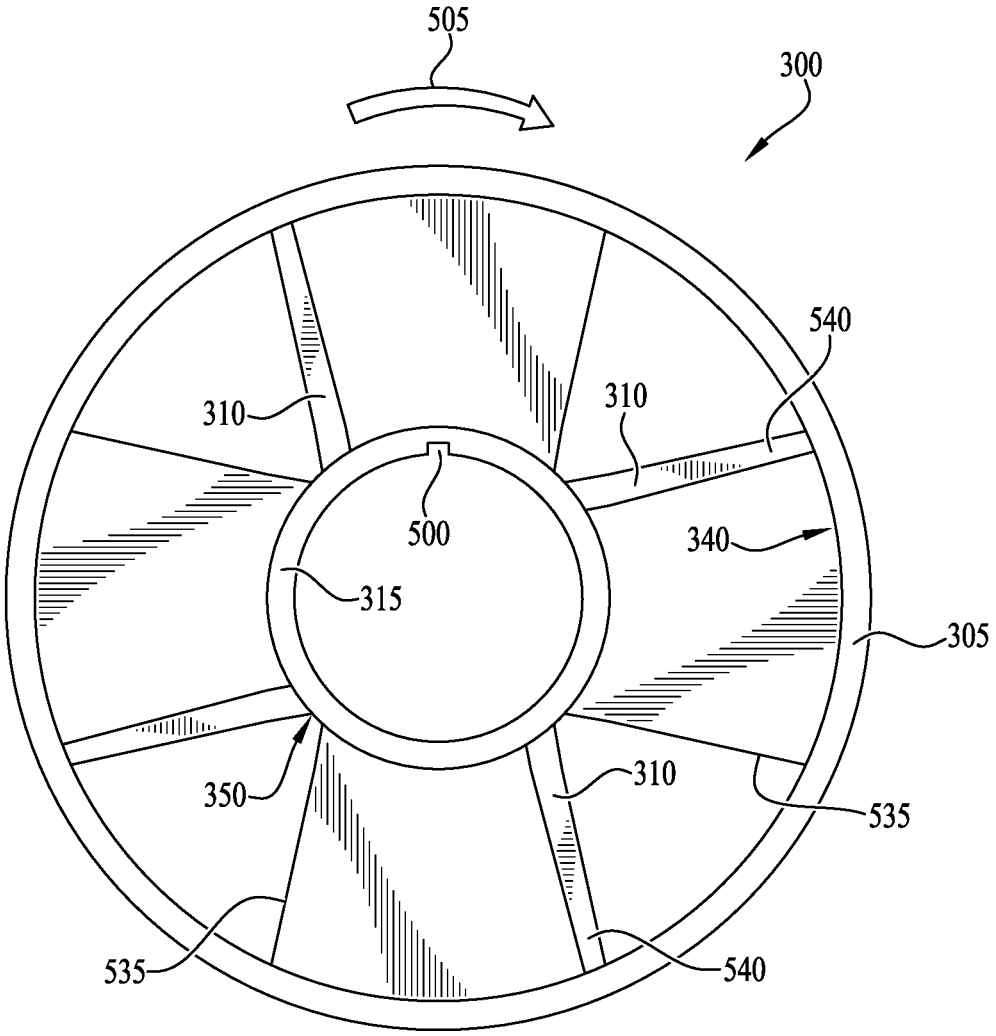
FIG. 5J is a top plan view of a propeller of an illustrative embodiment.

Turning to FIGS. 5G-5I, trailing edge 540 may be above leading edge 535 of each blade 310 for the span of blade 310. As shown in FIG. 5J, leading edge 535 of a first blade 310 may be circumferentially proximate to trailing edge 540 of an adjacent blade 310, with leading edge 535 of a first blade 310 below the trailing edge 540 of an adjacent blade 310. The curve of blade 310 lower face 530 and/or upper face 550 may resemble a wave, oscillation and/or an "S" shape having both concave and convex portions, as shown in FIGS. 5B. 5D and 5F. Blade 310 and/or propeller 300 geometry may allow blades 310 to impart axial momentum to gas rich fluid 405 passing between hub 315 and shroud 305, without increasing rotational momentum. Blades 310 may maintain a constant axial thrust across the radius of blade 310, which may limit centrifugal forces imparted to gas rich fluid 405 and/or reduce radial force on gas rich fluid 405. In this way, gas rich fluid 405 may be accelerated axially without accumulating radial acceleration, which radial acceleration might otherwise undesirably result in re-entrapment of gas bubbles and/or reversal of the separation process. Shroud 305 may partition gas rich fluid 405, inside propeller 300, from gas poor fluid 400.

Returning to FIGS. 2-3B, vortex generator 240 and/or a rotary may rotate with shaft 260 to produce vortex and/or rotationally induced phase separation of pumped fluid, resulting in gas rich fluid 405 and gas poor fluid 400. Gas poor fluid 400 (having a lower GVF than gas rich fluid 405) may travel downstream through channel 320 between the inner diameter of liner 230 and/or housing 225 and the outer diameter of shroud 305. Gas poor fluid 400 may then travel through production passage 245, production passage openings 255 and continue on to charge pump 125 and/or production pump 130. Gas rich fluid 405 may enter the space inside shroud 205 and be propelled upwards by propeller 300, progressing upwards into vent passage 250, where it may flow through vent ports 215 and into casing annulus 205. Propeller 300 may be secured inside separation chamber 210 and may be aligned axially with crossover skirt 355 and/or within the fluid column formed by gas rich fluid 405. The outer diameter of propeller 300 may be smaller than the inner diameter of separation chamber lining 230 and/or housing 225 such that gas poor fluid 400 may pass through channel 320 around the outer surface of propeller 300 and/or shroud 305, inside liner 230 and/or housing 225, and travel to centrifugal pump 130. On the other hand gas rich fluid 405 may pass between propeller hub 315 and propeller shroud 305 as it moves axially downstream.

Axial momentum of gas rich fluid 405 may increase due to the thrust imparted by propeller 300, which propeller 300 may increase the efficiency of gas removal of gas separator 150. On the other hand, gas poor fluid 400 may experience little or no change in momentum as a result of propeller 300. In some embodiments, propeller 300 may be located directly upstream of skirt 355 of crossover 220. In certain embodiments, propeller 300 may be located proximate vortex generator 240 or a rotor. In some embodiments, the diameter of propeller 300 may be similar to the diameter of skirt 355. The diameter of propeller 300 may be smaller than the inner diameter of housing 225 and/or liner 230 to provide space for channel 320.

The size and/or location of propeller 300 may be determined by fluid dynamics and/or shape of crossover 220, separation chamber 210, and/or other components of gas separator 150. In some embodiments two or more propellers 300 may be included in succession in separation chamber 210. In one example, elongating separation chamber 210 may increase the overall efficiency of gas separator 150 and/or may provide more time for gas poor fluid 400 and gas rich fluid 405 to separate prior to reaching crossover 220. Additional propellers 300 may be included in such elongated separation chamber 210 to provide gas rich fluid 405 sufficient axial momentum to proceed longitudinally through separation chamber 210 and pass through crossover 220 for ventilation into casing annulus 205.

In ESP assemblies where multiple gas separators 150 are used in tandem, propeller 300 may be used in one, some or all gas separators 150. In some embodiments, propeller 300 may have an open propeller design omitting shroud 305 but maintaining blades 310 of outwardly decreasing pitch and/or having washout twist.

Figure 6:
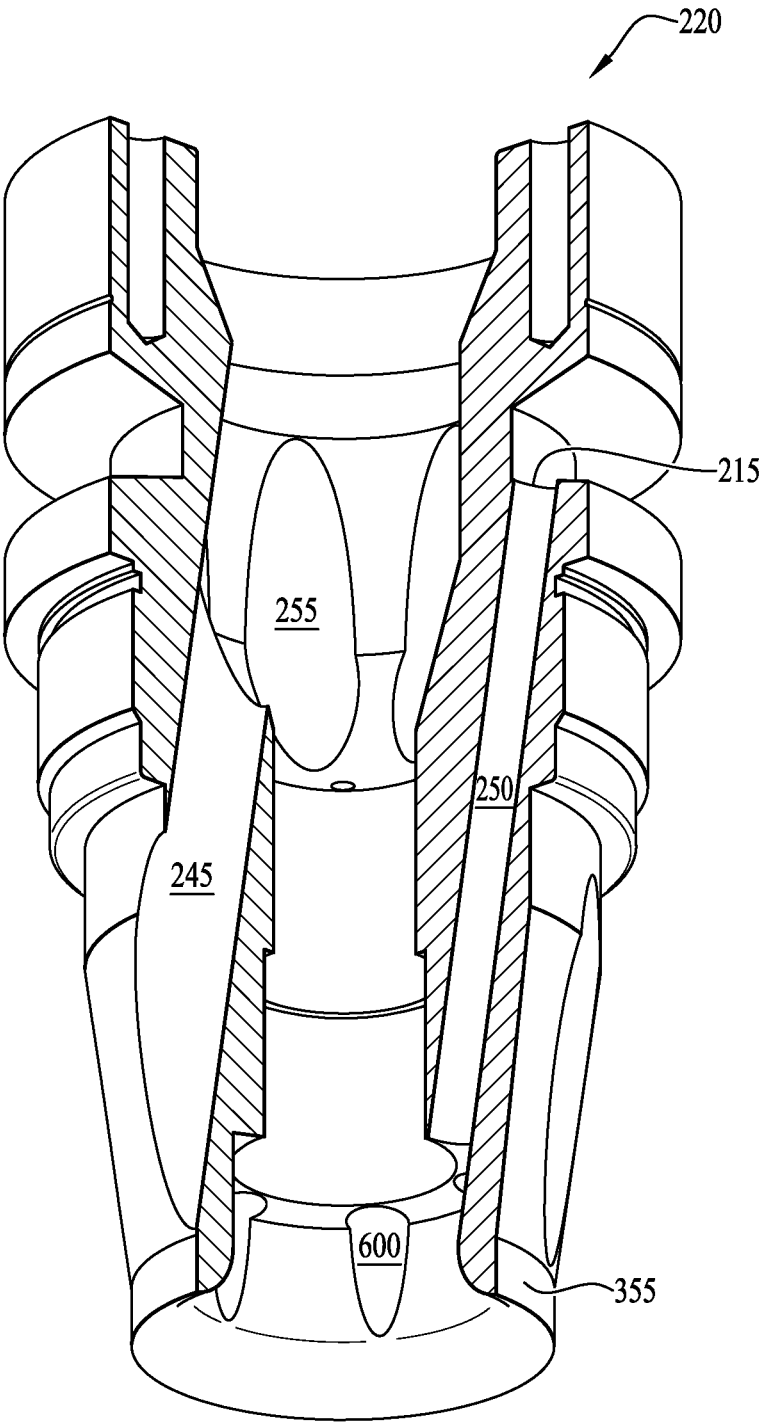
FIG. 6 is a perspective view of a crossover chamber of an illustrative embodiment.

Crossover 220 may be located downstream from separation chamber 210 and/or propeller 300. FIG. 6 illustrates a crossover of illustrative embodiments. Crossover 220 may include skirt 355, which may serve as the entry point for fluid passing through crossover 220. Vent passage openings 600 may couple fluid flowing through the inner diameter of skirt 355 into vent passage 250 that extends towards vent ports 215. Channel 320 that extends between propeller 300 and liner 230 and/or housing 225, and then between skirt 355 and liner 230 and/or housing 225, may be fluidly coupled to production passage 245 that extends through crossover 220 and continues through production passage openings 255 towards centrifugal pump 130. Housing 225 may enclose liner 230, providing structural support for gas separator 150 and separation between casing annulus 205 and liner 255.

Illustrative embodiments may allow more efficient removal of unwanted gas from production fluid which may reduce the likelihood of gas locking and/or gas-induced damaged to an ESP assembly. Illustrative embodiments may provide gas rich fluid 405 with improved axial momentum while preventing and/or reducing centrifugal forces that might otherwise increase the likelihood of re-entrapment of the gas. A method of illustrative embodiments may include employing propeller 300 inside gas separator 150 of ESP assembly 100. Propeller 300 may be placed inside separation chamber 210 and may be keyed or otherwise rotatably coupled to shaft 260. Propeller 300 may impart axial momentum of constant thrust across the span of blade 310 to gas rich fluid 405 exiting vortex generator 240 or rotor. Rather than passing through propeller 300, gas poor fluid 400 may pass around the outer diameter of propeller 300 through channel 320 and then into production passage 245 fluidly coupled to centrifugal pump 130. The additional momentum provided by propeller 300 may allow gas rich fluid 405 to be propelled through crossover 220 and exit vent ports 215, rather than being entrained in the production fluid, thereby reducing the GVF of fluid entering centrifugal pump 130.

An electric submersible pump gas separator has been described. Further modifications and alternative embodiments of various aspects of the invention may be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the scope and range of equivalents as described in the following claims. In addition, it is to be understood that features described herein independently may, in certain embodiments, be combined.

The invention claimed is:

1. An electric submersible pump (ESP) gas separator comprising: a propeller upstream of a fluid entrance to a crossover and at an upper section of a separation chamber, the propeller comprising a plurality of blades, each blade of the plurality of blades comprising washout twist; the crossover comprising a production pathway and a vent pathway; wherein gas rich fluid of multi-phase fluid travelling through the gas separator flows through the propeller and into the vent pathway, and gas poor fluid of the multi-phase fluid flows around the propeller and through the production pathway; and wherein the washout twist comprises pitch that increases in coarseness from the hub to the shroud of the propeller;

wherein each blade comprises an inner edge that curves concavely and convexly along an outer diameter of the hub and an outer edge that curves convexly and concavely along an inner diameter of the shroud.

2. The ESP gas separator of claim 1, wherein the propeller imparts axial momentum to the gas rich fluid exiting one of a vortex generator or rotary.

3. The ESP gas separator of claim 1, wherein the ESP gas separator is secured between a centrifugal pump and an induction motor, the production pathway extends to the centrifugal pump, and the vent pathway is configured to extend to a casing annulus.

4. The ESP gas separator of claim 1, the propeller further comprising a hub and a shroud, wherein the hub is keyed to a shaft of the ESP gas separator, and wherein each blade of the plurality of blades spans between the hub and the shroud.

5. The ESP gas separator of claim 4, wherein the shroud is axially aligned with a skirt of the crossover, and the gas rich fluid flows between the hub and the shroud.

6. The ESP gas separator of claim 1, wherein each blade comprises an inner edge that curves concavely along an outer diameter of the hub and an outer edge that curves convexly along an inner diameter of the shroud.

7. An electrical submersible pump (ESP) gas separator comprising: an intake section serving as an intake for fluid from a casing annulus into an ESP assembly; a separation chamber enclosed by a supportive housing and fluidly coupled to the intake section, the separation chamber comprising: a rotatable shaft extending centrally and longitudinally through the separation chamber; a vortex generator rotatably coupled to the rotatable shaft; a propeller within an upper section of the separation chamber that receives fluid from the vortex generator, the propeller rotatably coupled to the rotatable shaft downstream of the vortex generator, the propeller comprising at least one blade extending between a hub and a shroud of the propeller, wherein a pitch of each of the at least one blade increases in coarseness from the hub towards the shroud; and a fluid channel extending outward of the shroud inside the housing; and a crossover downstream of the propeller, the crossover comprising: a vent passage fluidly coupled to an inside of the shroud and the casing annulus; and a production passage fluidly coupled to the fluid channel and a production pump of the ESP assembly;

wherein each blade comprises an inner edge that curves concavely and convexly along an outer diameter of the hub and an outer edge that curves convexly and concavely along an inner diameter of the shroud.

8. The ESP gas separator of claim 7, wherein each of the at least one blades comprises an inner edge that curves concavely along an outer diameter of the hub, and an outer edge that curves convexly along an inner diameter of the shroud.

9. The ESP gas separator of claim 8, wherein each of the at least one blade twists such that at a leading edge of the at least one blade the inner edge is in front of the outer edge, and at a trailing edge of the at least one blade the outer edge is in front of the inner edge.

10. The ESP gas separator of claim 7, wherein each of the at least one blade comprises washout twist.

11. The ESP gas separator of claim 7, wherein an angle of incidence of each of the at least one blade, measured from a longitudinal axis, about doubles from the hub to the shroud.

12. The ESP gas separator of claim 7, wherein a leading edge of each of the at least one blade is below a trailing edge of the at least one blade.

13. The ESP gas separator of claim 7, wherein an upper face of each of the at least one blade comprises a convex portion and a concave portion.

14. The ESP gas separator of claim 7, wherein the propeller comprises four blades circumferentially spaced around the hub and the four blades curve helically around the hub.

15. The ESP gas separator of claim 7, wherein the propeller imparts axial momentum to fluid flowing through an inside of the propeller between the shroud and the hub.

16. An electric submersible pump (ESP) assembly comprising a gas separator between a centrifugal pump and an induction motor, the gas separator serving as an intake for fluid into the centrifugal pump and comprising a propeller in an upper section of a separation chamber and upstream of a fluid entrance to a crossover, the propeller comprising a plurality of blades, each blade having a pitch that increases in coarseness from a hub towards a shroud of the propeller;

wherein each blade comprises an inner edge that curves concavely and convexly along an outer diameter of the hub and an outer edge that curves convexly and concavely along an inner diameter of the shroud.

17. The ESP assembly of claim 16, further comprising a channel surrounding a shroud, the channel fluidly coupled to the centrifugal pump.

18. The ESP assembly of claim 17, wherein a portion of the fluid that flows between the hub and the shroud of the propeller is coupled to a vent port of a crossover and the channel surrounding the shroud is fluidly coupled to the centrifugal pump.

19. The ESP assembly of claim 18, wherein the fluid comprises gas and liquid, and wherein the portion of the fluid that flows between the hub and the shroud comprises gas rich fluid and the channel comprises gas poor fluid.

20. The assembly of claim 16, wherein the gas separator comprises a vortex generator upstream of the propeller.

21. The assembly of claim 16, wherein the gas separator comprises a rotor upstream of the propeller.

22. The ESP assembly of claim 16, wherein the ESP assembly is configured for placement in a downhole well and the fluid comprises oil and gas.

23. The ESP assembly of claim 16, wherein each blade of the plurality of blades comprises washout twist.

24. The ESP assembly of claim 16, wherein each blade of the plurality of blades is concave at the hub and convex at the shroud.

* * * * *